US005341597A

United States Patent [19]

Stoltenberg

[11] Patent Number: 5,341,597

[45] Date of Patent: Aug. 30, 1994

[54] POWER OPERATED GARAGE DOOR

[76] Inventor: Donald A. Stoltenberg, 419 N. Ashland Ave., Park Ridge, Ill. 60068

[21] Appl. No.: 8,557

[22] Filed: Jan. 22, 1993

[51] Int. Cl.[5] ..... E05F 11/00

[52] U.S. Cl. ..... 49/199; 49/28; 49/225; 49/254

[58] Field of Search ..... 49/199, 200, 225, 209, 49/223, 224, 254, 28

[56] References Cited

U.S. PATENT DOCUMENTS

| | | | |
|---|---|---|---|
| D. 245,264 | 8/1977 | Andresen . | |
| 1,252,448 | 1/1918 | Kees . | |
| 1,848,311 | 3/1932 | Brower | 49/199 |
| 2,695,170 | 11/1954 | Bacque . | |
| 2,759,227 | 8/1956 | Reid et al. . | |
| 3,118,189 | 1/1964 | Dugger . | |
| 3,478,469 | 11/1969 | Estes . | |
| 3,568,365 | 3/1971 | Pemberton et al. . | |
| 3,616,575 | 11/1971 | Harris . | |
| 3,913,266 | 10/1975 | Smith . | |
| 4,417,418 | 11/1983 | Warning . | |
| 4,472,910 | 9/1984 | Iha | 49/200 X |
| 4,611,430 | 9/1986 | Altrogge . | |
| 4,855,653 | 8/1989 | Lemirande | 49/28 X |

FOREIGN PATENT DOCUMENTS

| | | | |
|---|---|---|---|
| 3411802 | 10/1985 | Fed. Rep. of Germany | 49/200 |

OTHER PUBLICATIONS

Four page sales brochure by Cybiag Door Co. bearing heading "A Garage Door Can Now Be . . . A Continuation of Your Design" published in the United States in 1991.

*Primary Examiner*—Philip C. Kannan
*Attorney, Agent, or Firm*—Neil M. Rose

[57] ABSTRACT

A power operated door which fits into a wall opening with an outer surface flush with the outer wall surface and displaceable upwardly to a horizontal open position by tilting the top of the door inwardly and then sliding it in vertical and horizontal tracks to the open position. A first drive mechanism on the door tilts it about a lower bearing and a second drive mechanism drives the door upwardly and downwardly by means of flexible connectors which pull upwardly and downwardly on the bottom of the door.

19 Claims, 5 Drawing Sheets

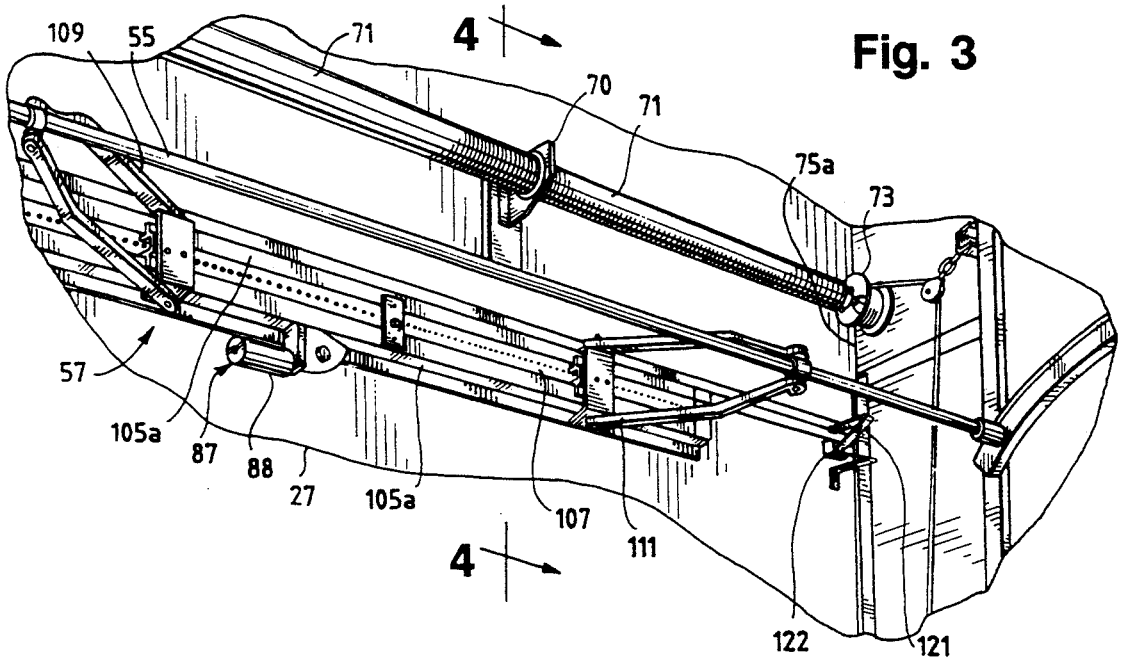
Fig. 3
Fig. 4
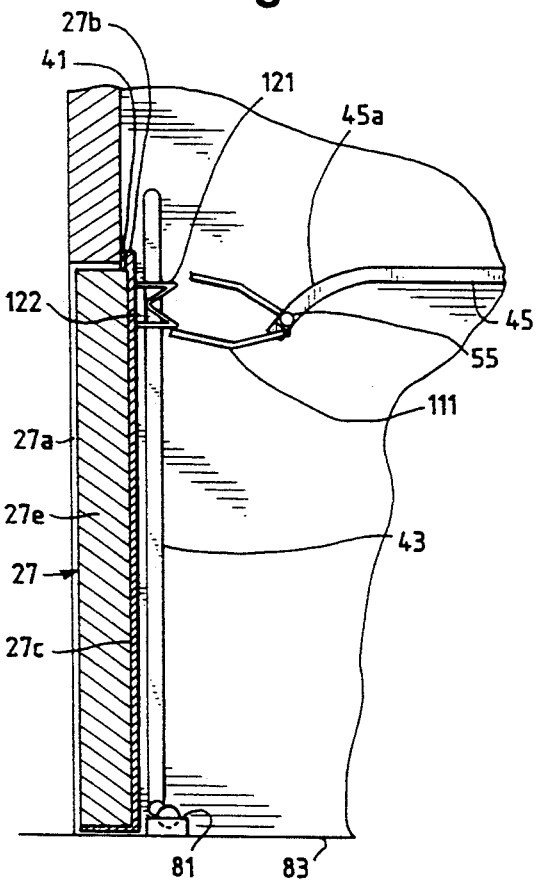
Fig. 5
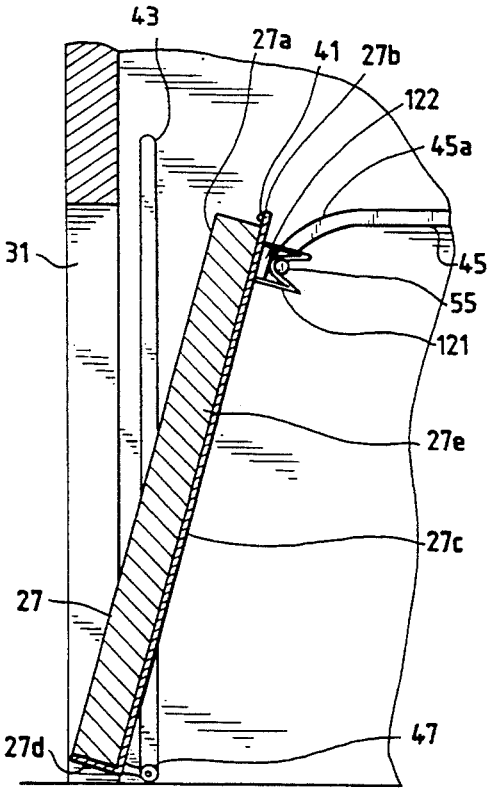

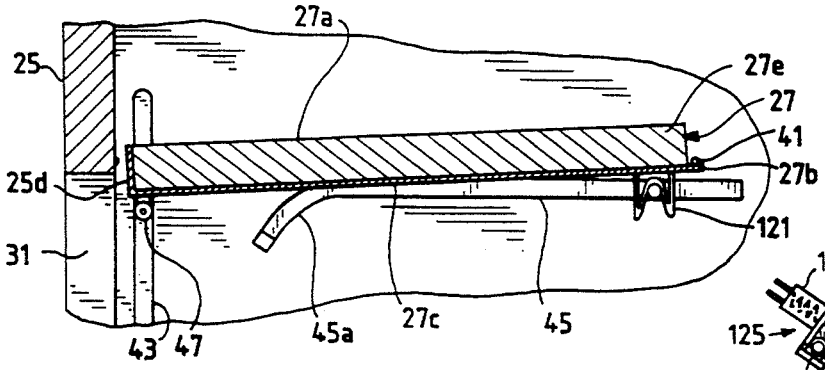
Fig. 6
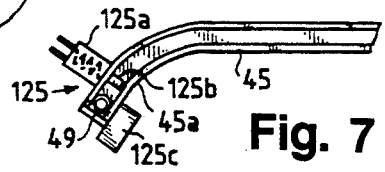
Fig. 7
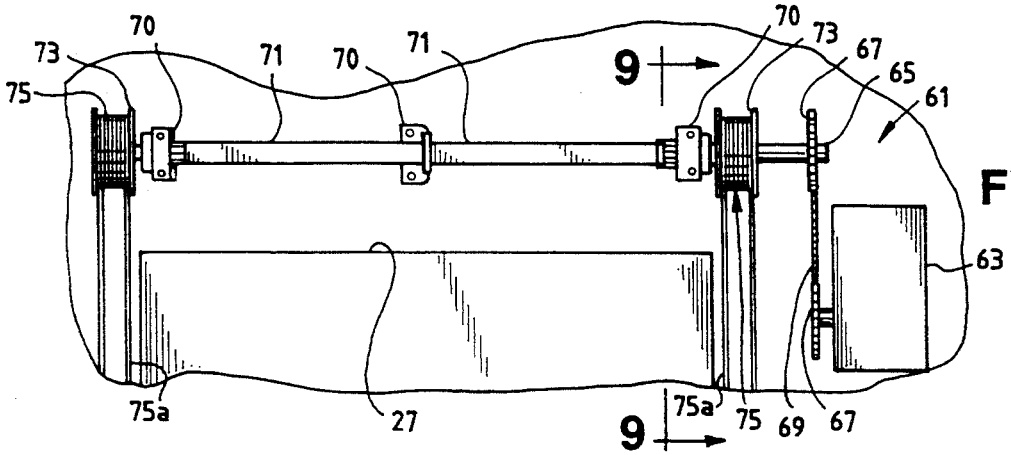
Fig. 8
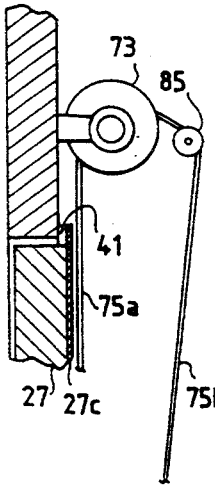
Fig. 9
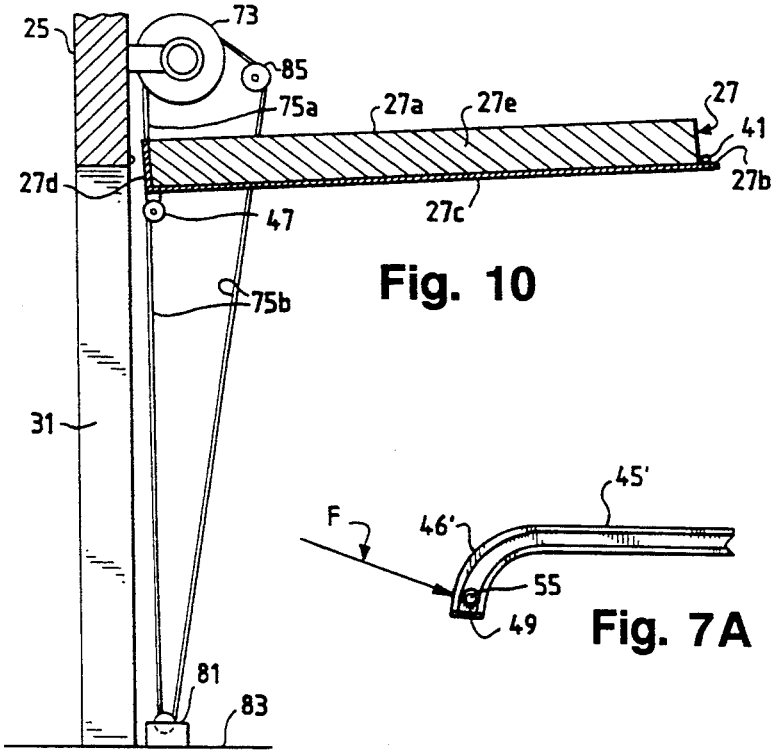
Fig. 10
Fig. 7A

POWER OPERATED GARAGE DOOR

BACKGROUND OF THE INVENTION

The present invention relates generally to power operated garage doors and specifically to a garage door opening mechanism for use with a door which is concealed in the exterior wall of a building.

It has become very common for houses to be constructed with one or more automobile garages built into the house. With the garage being integrated with the home rather than in a separate building, the residents of the home have the convenience of being able to enter and exit their automobiles without being exposed to the weather and at a minimum distance from their living areas in the home. The garage doors of such built-in garages are normally opened and closed by power operated apparatus which may be controlled by means located within the house or by remote control means located within the automobile. This arrangement allows the residents to enter and exit their automobiles within the safety and shelter of their home without being exposed to the weather or other risks.

The typical power operated garage door comprises a series of horizontally extending panels which are hingeably connected to each other and are supported for movement from a vertical position closing the garage opening to a horizontal position along the ceiling of the garage. Rollers which support the panels are received in channel-shaped tracks which extend vertically on either side of the door opening and then extend horizontally along the ceiling of the garage.

There are also one-piece doors which are supported by various types of mechanisms to move from the vertical closing position to a generally horizontal and elevated open position. The most common type of one-piece door is supported at the midpoint of its sides by swivel hardware that rotates the door between its vertical and its raised horizontal position. During this movement the bottom of the door typically moves outwardly so that the door projects partially outside of the door opening. This type of one-piece door presents several disadvantages in being difficult to seal when closed and in requiring a clearance space in front of the door to permit opening movement. Another type of one-piece door which does not project outwardly of the door opening is shown in the stet to Kees U.S. Pat. No. 1,252,448 which supports the lower edge of the door in a set of generally vertical tracks and supports the upper edge of the door in a set of generally horizontally extending tracks. A similar one-piece door support is disclosed in Pemberton, et al. U.S. Pat. No. 3,568,365.

It is typical of most prior art garage doors (other than the swivel mounted doors discussed above) to dispose the doors completely within the building, inside of the building wall, so that the door may move upwardly to its open position. If the door projected into the door opening, it would prevent the door from moving vertically without first being withdrawn inwardly. As a consequence, garage doors are typically recessed or inset from the face of this wall defining the opening by a distance of eight to twelve inches. Many attempts have been made to provide ornamentation or decoration on the doors to enhance their appearance. However, the recessed position of the doors makes it difficult to create an attractive appearance which blends with the architectural appeal of the house.

In recent years the increase in land cost has caused larger homes to be constructed on smaller pieces of property. The smaller lot size often necessitates that the garage be placed on the front side of the home where the garage door further detracts from the appearance of the house. The trend toward the inclusion of two and three car garages further magnifies the problem of providing an attractive and appealing home design with two or three garage door openings located in the wall of the building.

In addition, to the different types of garage doors that have been developed and are in current use, there are power drive mechanisms that have been developed for use with these various types of doors. The most common type is used with the multiple panel door and simply connects directly to the upper panel and moves horizontally back and forth on the ceiling to raise and lower the door. A screw or chain mechanism is used to drive the door. Such doors normally include springs to counterbalance the weight of the door so that the door may be operated manually. Therefore, the power mechanism drives the door downwardly or closed as well as driving it in the raising or opening direction.

Because of the substantial power required to move the garage door, there are safety considerations involved in the design of controls for power operated garage doors. Of greatest concern is the possibility of the door being closed when someone or something is in the path. With the power needed to move the substantial mass of the garage door, the door has the capacity to cause serious injury if it impacted a person as it moves toward the closed position. As a consequence, standards have been established requiring that power operated garage doors be equipped with safety devices to prevent injury to a person in the path of the doors as they close.

These safety devices include light beam operated switches to sense obstructions in the door opening, pressure operated switches on the edge of the door, and control circuits responsive to the speed or load on the door driving motor. The latter type of circuits are preferred since they are the least expensive, involving the addition of relatively inexpensive components to the drive motor control circuit. These circuits sense the engagement of the door against an obstacle by the drop in rotational speed of the drive motor or the increase in motor current as the motor begins to stall on encountering an obstacle. There are also garage door drive means including mechanical load sensing means between the motor and the door drive to mechanically sense the load increase and provide a signal to reverse the motor direction of rotation. Upon sensing such an obstacle to closing movement of the door, the control circuit causes the motor to stop or reverse, thereby preventing injury if the obstacle is a person. Safety devices including such motor control circuits responsive to motor speed or load are common and well known in the power operated garage door opening field.

There are limitations on the types of power operated doors to which the motor control safety circuits are applicable. Thus, there is a type of door drive mechanism that uses the motor to raise the door and allows the door to close under the force of gravity. This approach is typical of industrial or commercial power operated doors. Another type of door drive mechanism utilizes a roller chain or screw to drive the door in both the opening or closing direction. The chain or screw drive is most commonly used with the hinged panel garage doors described above. Since the chain or screw drive mechanism powers the door in the closing direction, it is easily adapted to use a safety circuit responsive to motor load or speed to prevent injury to an obstacle encountered as the door moves in the closing direction. On the other hand, the industrial/commercial drive mechanism using a cable to raise the door and lower or close it by gravity is not adaptable to the use of the above described motor safety circuit. Accordingly, it has been necessary to utilize pressure sensitive switches and light beam controlled switches to provide the safety protection required in connection with the industrial type doors which are raised by a motor driven cable and lowered by gravity.

BRIEF SUMMARY OF THE INVENTION

The present invention provides a mechanism for opening and closing a garage door which is mounted within a wall opening with the outer surface of the door coplanar with the outer surface of the wall. The door surface may be made to be compatible with and blend in with the adjacent portions of the building wall to make it possible to conceal the presence of the door in the wall. The arrangement permits an architect to place one or more garages in a home while not disrupting or detracting from architectural appeal by having the usual recessed garage door opening being visible.

The garage door of the present invention is a one-piece door which is power operated between a vertically disposed closed position and a horizontally disposed raised or open position adjacent the ceiling of the garage. Vertical tracks adjacent the sides of the door and horizontal tracks extending inwardly from the top of the door opening receive and guide bearing means on the door to guide the door in its movement. A first drive mechanism mounted on the door displaces the top of the door inwardly with respect to an upper bearing shaft, causing the door to pivot or tilt inwardly about bearing means at the lower edge of the door. A second drive mechanism then drives the lower edge of the door vertically with the vertical and horizontal tracks guiding the door for movement between the closed and open positions. The initial tilting movement of the door withdraws the top of the relatively thick door inwardly sufficiently so that the door will have clearance to move upwardly as it continues to pivot to its horizontal open position.

The opening of the door is accomplished by a flexible cable wound up by the second drive mechanism and connected to the lower portion of the door to draw the lower edge of the door vertically in moving from the closed to the open position. The closing of the door is accomplished by another flexible cable which extends from the second drive mechanism to the lower portion of the door while being looped around a pulley fixedly mounted adjacent the bottom edge of the door so that this flexible cable may pull the door downwardly upon the closing of the door. By utilizing a flexible cable which drives the door downwardly, the safety requirements for a power operated garage door may be met by the inclusion of a motor reversing circuit which responds to decreased motor speed or increased motor load to reverse the direction of door movement if it encounters an obstruction when moving in the door closing direction. Thus, as the second drive mechanism winds up the cable to pull the door downwardly and the door encounters an obstruction, the motor will slow or stop, causing the circuit to reverse the motor drive direction, resulting in the door moving upwardly toward the open position.

The first drive mechanism includes a reversible gear motor connected to drive a sort of scissors linkage which comprises a pair of yokes pivotally connected to a horizontally disposed bearing shaft. The yokes have ends remote from the shaft which are supported on sliders movable along a rectilinear path toward and away from each other to displace the shaft away from and toward the door. The outer ends of the shaft mount rollers which are received in the horizontal tracks to guide the movement of the upper or top edge of the door. At the closed position of the door, the yokes are extended, causing the shaft to be well spaced from the vertically disposed door. In the first stage of the door opening, the first drive mechanism causes the sliders to move toward each other, which motion causes the door to pivot about its lower edge tilting inwardly until the shaft is disposed closely adjacent the door. Upon the closing of the door, the first drive mechanism operates after the second drive mechanism has driven the door to its lowered and inwardly tilted position. At that point in the closing cycle, the first drive mechanism expands the scissors linkage, causing the yokes to drive the door back to its vertical position.

In order to prevent the rollers on the ends of the bearing shaft from being displaced from the ends of the horizontal tracks during the final stage in the closing cycle, there is provided a solenoid operated lock which becomes operative when the bearing shaft rollers move to the forward end of the horizontal tracks. The solenoid operated lock places a barrier to the movement of the rollers rearwardly from the forward end of the horizontal tracks. Accordingly, when the first drive mechanism expands the scissors linkage, the door is pushed from its titled to the vertical position rather than pushing the bearing shaft rearwardly in the horizontal tracks and leaving the door in its tilted position.

The door support panel is formed with peripheral edges along the vertical sides and top of the door. These peripheral edges extend outwardly from the door and overlay the inner edges of the wall defining the door opening to assure a good seal between the door and the wall in which the door opening is formed. Because of the fact that the final stage of the door closing cycle involves a pivotal movement of the door around bearings at the lower edge of the door, the peripheral edges move substantially normal to the inner surface of the wall whereby a suitable sealing gasket is compressed between the peripheral edges of the door and the inner surface of the wall.

Accordingly, it is an object of the present invention to provide an improved power operated door which is movable from a vertical flush mounted position in a door opening to horizontal elevated or raised position.

It is a further object of the present invention to provide an improved power operated door which moves through two stages, the first being a pivotal tilting movement about the lower edge, and the second being a compound translational and pivotal movement to a horizontal raised position.

It is another object of the present invention to provide an improved power operated door for a one-piece door which is driven by flexible drive members driven by a reversible motor to drive the door in both the opening and closing directions.

BRIEF DESCRIPTION OF THE DRAWINGS

While the present invention is described with particularity in the claims annexed to and forming a part of this specification, a better understanding of the invention can be had by reference to the following description taken in conjunction with the accompanying drawings in which:

FIG. 3 is a fragmentary perspective view of the garage door of FIG. 2 from the inside, showing the mechanism for tilting the garage door;

FIG. 4 is a vertical section of a power operated garage door embodying the invention taken on line 4—4 of FIG. 3;

FIG. 5 is a vertical sectional view similar to FIG. 4 but with the door in a tilted, partially open position;

FIG. 6 is a fragmentary, vertical sectional view similar to FIGS. 4 and 5 but with the door in a fully open, raised position, FIG. 7 is an enlarged view on the inner end of one of the horizontal tracks for guiding the door showing the locking means for the guide roller;

FIG. 7A is a view similar to FIG. 7 showing an alternative embodiment of the inner end of the horizontal tracks;

FIG. 8 is an elevational view of the top of the garage door from the inside showing the jack shaft and cable supporting drums which power the door up and down;

FIG. 9 is a sectional view taken on line 9—9 of FIG. 8 showing the door in the closed position;

FIG. 10 is a sectional view similar to FIG. 9 but with the door shown in the open position;

DESCRIPTION OF THE PREFERRED EMBODIMENT

Figure 1:
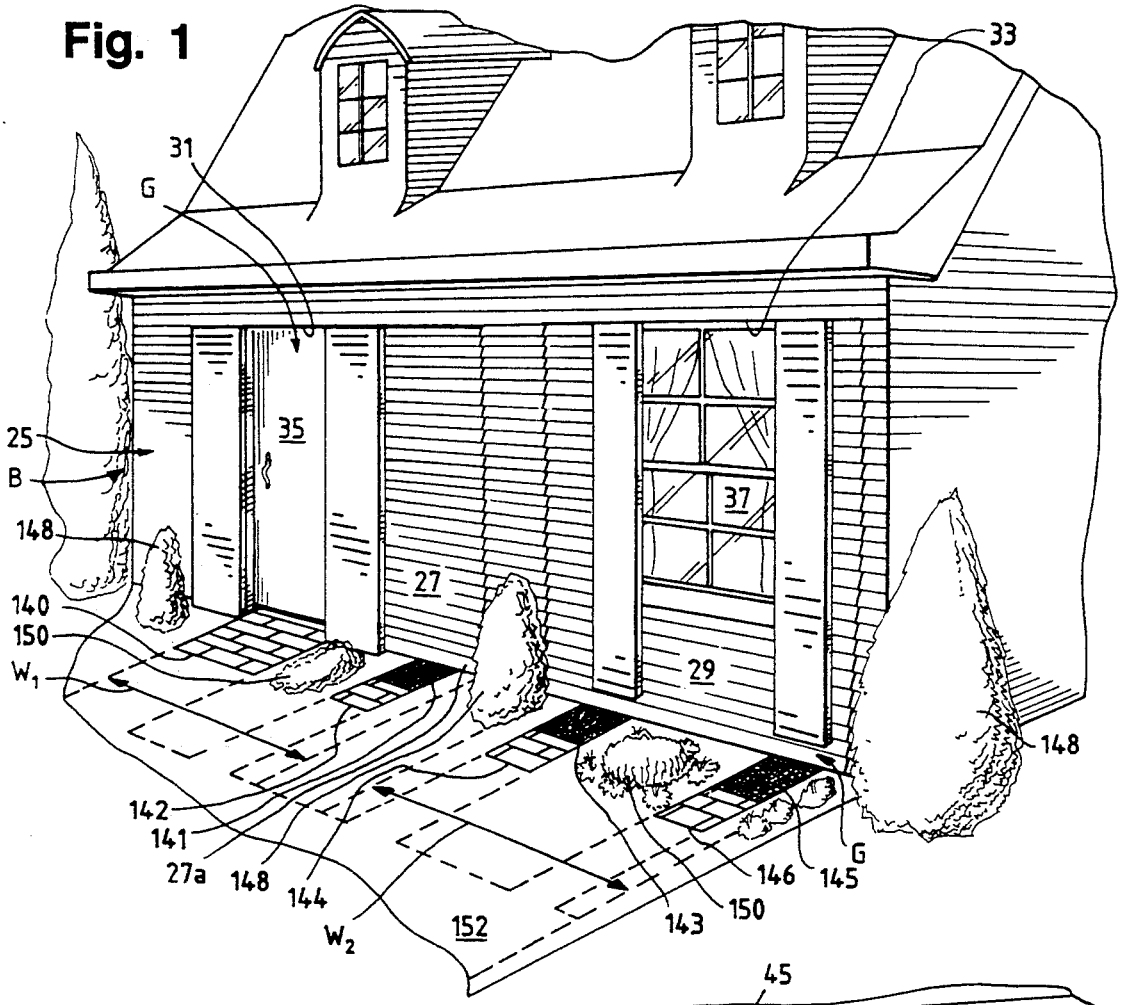
FIG. 1 is a perspective view of a building having power operated garage doors embodying the present invention.
Figure 2:
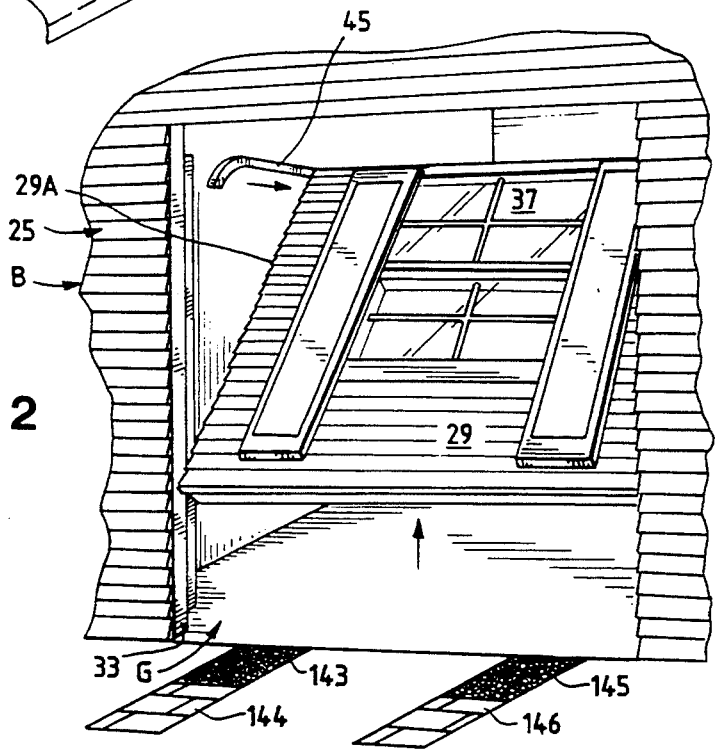
FIG. 2 is an enlarged perspective view of a portion of the building of FIG. 1 showing one of the garage doors in a partiality elevated position.

Shown in FIGS. 1 and 2 is building "B" which may be a residence having one or more built-in garages "G" to accommodate one or more vehicles. As shown in FIG. 1, the building B has a front wall 25 within which are mounted garage doors 27 and 29 which are selectively positionable to close garage openings 31 and 33, respectively. The garage doors 27 and 29 are disposed vertically in their closed positions and mounted for guided upward and pivotal movement to a raised open position in which the doors are disposed horizontally adjacent the ceiling of the garage.

As is evident from FIGS. 1 and 2, the doors 27 and 29 of the invention are formed with outwardly facing surfaces **27*a* and 29*a* which are substantially flush with the surface of front wall 25 and which are configured to blend with the front wall 25, concealing the presence of the doors when in the closed position. The doors 27 and 29 may be formed with siding as shown or in the case of a brick house, the doors 27 and 29 would be provided with a matching brick surface. If desired for appearance reasons, the doors 27 and 29 may be formed with a pedestrian door 35 or a bay window 37. Thus, the doors 27 and 29 may have any desired appearance, including visual features such as shutters, windows, and doors which project slightly forward of the adjacent surface of the wall 25**.

Because of the fact that the doors 27 and 29 are positioned largely within the openings 31 and 33, it is not possible for the doors 27 and 29 to be opened by simply sliding them vertically as is typical with recessed garage doors. The power operated door of the present invention provides means for tilting the doors about their bottom support bearing before elevating the doors. To best understand the motion of the doors 27 and 29 in moving between the closed and open position, reference should be made to FIGS. 4–6 which show sectional views of door 27 in the closed, partially open and full open positions, respectively.

The door 27 is shown schematically in FIGS. 4–6 with no attempt to illustrate the texture, nature or ornamentation that would preferably be placed on the surface **27*a* to provide a compatible surface with the wall 25 to thus conceal the presence of the opening 31 and door 27 within the wall 25. Along the inner top edge of door 27, there is provided a horizontally extending edge 27*b* which extends along the inside of the wall 25 and carries a gasket member 41. The edge 27*b* and gasket member 41 extend down the vertical edges of the door 27. The gasket 41 is compressed between the edge 27*b* and the inner portion of wall 25 surrounding the opening 31 when the door 27 moves to the closed position. Alternatively, the gasket member 41 may be mounted on the inner surface of the wall 25 surrounding the opening 31 so that the edge 27*b* engages gasket member 41 to seal the door 27 to the wall 25**.

The door 27 is preferably formed with a support portion **27*c* which extends across the inner face of the door and includes a ledge member 27*d* at its lower edge. The support portion 27*c* with its ledge 27*d* functions to mount and support the decorative panel 27*e*** which would normally be constructed on the building site to match the adjoining wall portion of the building in which the door opening is located.

Figure 11:
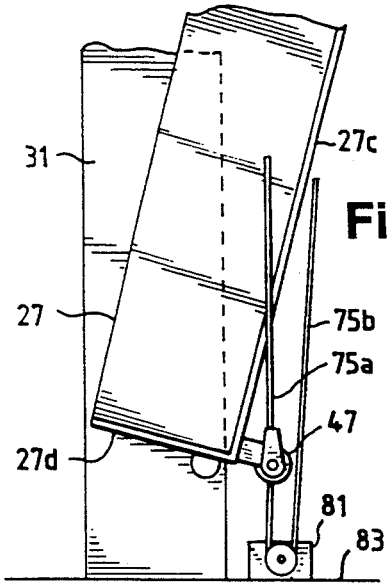
FIG. 11 is an enlarged, fragmentary, sectional view similar to FIG. 5 illustrating the cable attachment to the lower edge of the door.
Figure 12:
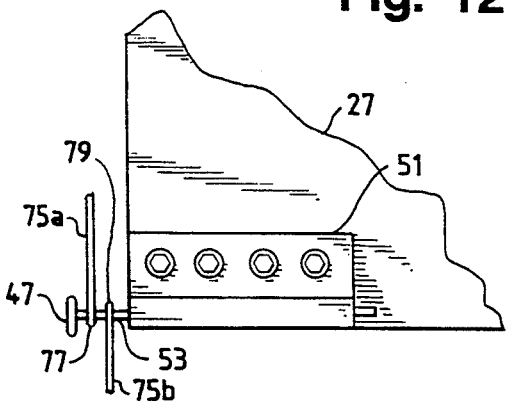
FIG. 12 is a fragmentary view showing one of the lower door bearings and the drive cable connections to the door.
Figure 13:
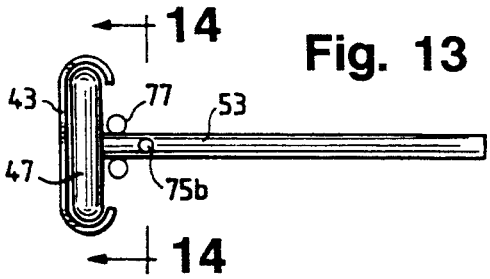
FIG. 13 is an enlarged, fragmentary, sectional view showing one of the lower door rollers engaged with its guide track.
Figure 14:
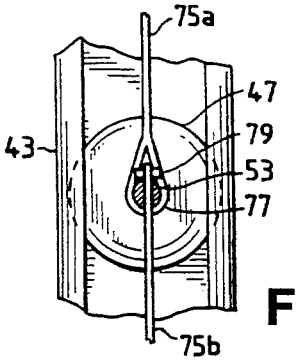
FIG. 14 is a fragmentary, sectional view taken on line 14—14 of FIG. 13.

For the purpose of supporting and guiding the movement of the door 27, there are provided sets of opposed vertical tracks 43 and horizontal tracks 45 which receive pairs of support rollers 47 and 49. As shown in FIGS. 11 and 12, the pair of rollers 47 are mounted at the bottom of the inner edge of the door 27 by brackets 51 which mount support shafts 53. The tracks 43 are channel shaped in cross section and receive the rollers 47 as illustrated in FIG. 13 to guide the rollers 47 along a substantially vertical path.

The rollers 49 which support and guide the upper edge of the door 27 are mounted on the ends of a support shaft 55 which is movably mounted at the inner face of door 27 toward the top edge. A lever or scissors mechanism 57 shown in detail in FIGS. 3 and 15–18 and omitted from FIGS. 4–6 is for the purpose of moving the shaft 55 between a first position spaced from the top of door 27 as shown in FIG. 4 and a second position closely adjacent to the top of door 27 as shown in FIG. 5. Thus, as the door 27 moves from the closed position shown in FIG. 4, it tilts inwardly about the lower bearing or rollers 47 to assume the position shown in FIG. 5. This tilting action is caused by the displacement of the shaft 55 with respect to the door 27 which displacement is caused by the mechanism 57 in a manner to be explained in detail below. The tilting of the door 27 about its lower bearings or rollers 47 displaces the top of the door 27 inwardly out of the opening 31 so that there will be no interference between the door 27 and the upper edge of the opening 31 as the door begins its upward movement. The mechanism 57 includes an automatically controlled reversible electric motor to drive the shaft 55 between its alternative positions as will be explained below.

To lift the door 27 upwardly from the tilted position shown in FIG. 5 to the raised or open position shown in FIG. 6, there is provided a power drive mechanism 61 shown in detail in FIGS. 8–10 and including a reversible electric motor 63 which drives a jack shaft 65. Sprockets 67 and roller chain 69 drivingly connect the motor 63 and the jack shaft 65. The jack shaft 65 is mounted on the inside of wall 25 by bearing members 70 and is provided with known counterbalance springs 71 which bias the door 27 upwardly to reduce the power necessary to raise the door.

Mounted on the jack shaft 65 at the edges of the door 27 are cable drums 73 on each of which is wound a flexible drive cable 75. A first portion 75*a* of the cable extends vertically downwardly from drum 73 to a looped end 77 which surrounds the roller support shaft 53 as is best shown in FIGS. 11–14. In order to raise the door 27 from the position shown in FIG. 5, the drive mechanism 61 rotates the drums 73 clockwise as shown in FIGS. 9 and 10 drawing the cable 75*a* upwardly and through the loop connection to shaft 53 pulling the lower edge of door 27 upwardly.

The cable 75 is provided with a second portion 75*b* which connects to the shaft 53 as shown in FIGS. 11–14 and which functions to pull the door 27 downward from the open to the closed position. The end of the portion 75*b* extends through an opening in shaft 53 and is provided with a termination member 79 which may be suitably secured to the cable end to prevent the cable end from being withdrawn through the hole in shaft 53. In order to permit the drive mechanism 61 to pull the door 27 downwardly, a pulley 81 is mounted at floor 83 on each side of the door opening 31 inside of the wall 25 as shown in FIGS. 4, 10 and 11. The cable portion 75*b* extends from the drum 73 around a pulley 85, then downwardly around the pulley 81, and, finally, upwardly for interconnection with the door 27. If not required to provide space and clearance for the cable portion 75*b*, the pulley 85 may be omitted and the cable portion 75*b* may extend directly from the drum 73 downwardly to the pulley 81. When the door 27 is driven from the open to the closed position, the drum 73 rotates counterclockwise as viewed in FIG. 10 causing the cable portion 75*b* to pull the door 27 toward the closed position.

It should be understood that the flexible cable 75 with its portions 75*a* and 75*b* could comprise two separate cables or one continuous cable. It is also contemplated that the cable 75 could be replaced by a roller chain driven and supported by sprockets rather than a drum and pulleys.

Figure 16:
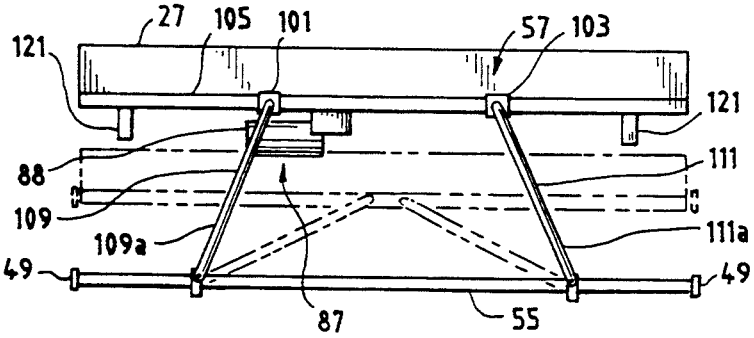
FIG. 16 is a plan view of the top of the door showing the scissors linkage for displacing the upper bearing support shaft laterally.
Figure 17:
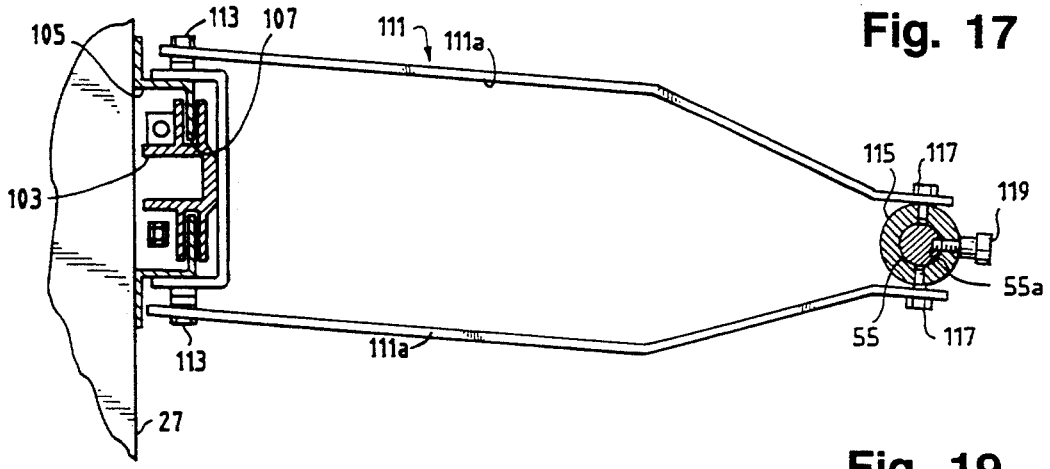
FIG. 17 is an enlarged, sectional view taken on line 17—17 of FIG. 15.
Figure 19:
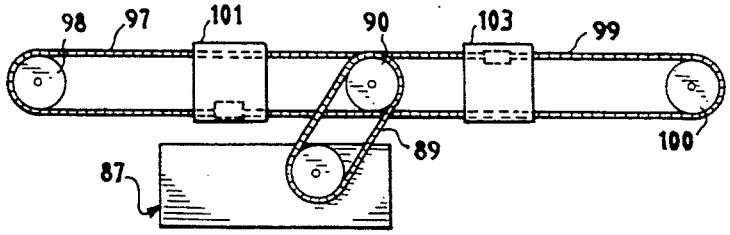
FIG. 19 is a schematic showing of the drive mechanism for the scissors linkage.
Figure 18:
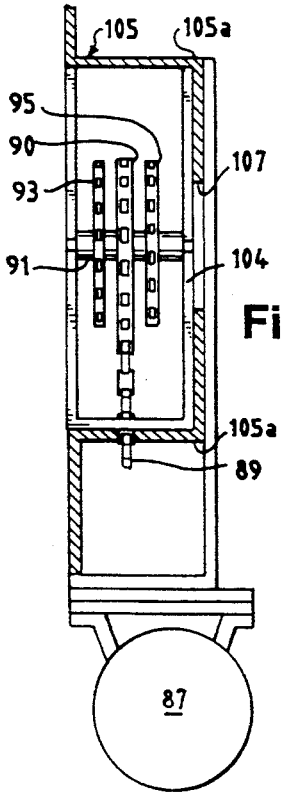
FIG. 18 is an enlarged sectional view taken on line 18—18 of FIG. 15.

The mechanism 57 for displacing the shaft 55 laterally with respect to the door 27 is shown in detail in FIGS. 3 and 15–19. The mechanism 57 is driven by a gear motor 87 which mounted in the inside surface of door 27 and which is powered by a reversible electric motor 88. The gear motor 87 has an output which drives a roller chain 89 shown in FIG. 19. The roller chain 89 drives a sprocket 90 keyed to a shaft 91 which supports sprockets 93, 95 which drive roller chains 97 and 99. The shaft 91 is supported with its ends journaled in a U-shaped frame member 104 as shown in FIG. 18. The roller chains 97 and 99 are continuous loops with their portions remote from shaft 91 being supported by idler sprockets 98 and 100, respectively, as shown in FIG. 19. The roller chains 97 and 99 are connected to slide members 101 and 103 which move in opposite directions along a rectilinear path as they are driven by the gear motor 87.

Figure 15:
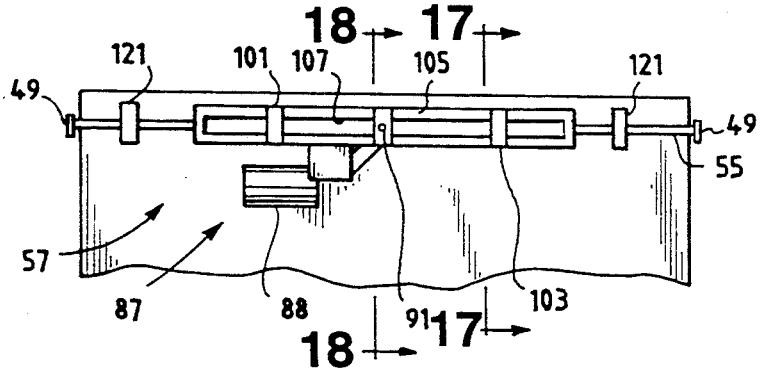
FIG. 15 is an elevational view of the top of the door showing the upper bearing support shaft.

As shown in FIGS. 15 and 17, a horizontally disposed track 105 extends across the top of door 27 having a slot 107 in which the slide members 101 and 103 are received. The track 105 is formed by a pair of struts 105*a* which have Z-shaped cross sections and are secured to the door in spaced relation as shown in FIGS. 3 and 17 providing the slot 107 therebetween. To drivingly interconnect the slide members 101 and 103 with the shaft 55, there are provided yoke members 109 and 111. The yoke members are pivotally connected at one end to the slide members 101 and 103 and at their other ends to the shaft 55. Pivot bolts 113 secure the yoke members to the slide members as illustrated by FIG. 17 Each of the yoke members is formed by two spaced levers 109*a* and 111*a*, the ends of which straddle the slide members and the shaft 55 as is evident from FIG. 17. The openings in the levers 109*a* and 111*a* through which the pivot bolts 113 extend are elongated lengthwise of the levers so as to accommodate the downward angling of the yoke members 109 and 111 as the door moves from its angled position (FIG. 5) to the vertical position (FIG. 4).

The yoke members 109 and 111 are pivotally connected to the shaft 55 by means of a ring 115 which is slidably received on the shaft 55. Bolts 117 pivotally connect the ends of the yoke members to the rings 115. In order to provide a detachable connection between the yoke members and the shaft 55, the connection between the ring 115 and the shaft 55 is made by a movable pin or plunger 119 which is manually displaceable between an engaged position received in a recess 55*a* in shaft 55 and a disengaged position in which it is withdrawn axially from the recess in shaft 55 so as to permit relative movement between ring 115 and shaft 55. The purpose of this detachable connection is to permit manual disengagement of the mechanism 57 in the event of a power failure so that the door 27 may be tilted inwardly manually and then lifted manually using a chain hoist conventionally provided to permit manual operation of jack shaft driven doors.

As indicated above, the roller chains 97 and 99 are connected to the slide members 101 and 103 so that they will be driven in opposite directions along the track 105. FIG. 16 illustrates in solid lines the relative position of the door 27 and the shaft 55 when the door is in the closed position. The initial actuation of the gear motor 87 causes the slide members 101 and 103 to move toward each other causing the yoke members 109 and 111 to pivot toward the shaft 55. This folding action of the yoke members draws the door toward the shaft 55 as illustrated by the dash line showing of the door 27 in FIG. 16. This action produces the motion of the door 27 as indicated by FIGS. 4 and 5. In the tilted position of the door, the shaft 55 is received in a pair of fork members 121 which engage the shaft 55 toward its opposite ends. The fork members permit the weight of the doors 27 to be supported directly on the shaft 55 rather than having the weight supported through the mechanism 57,and the yoke members 109 and 111.

In order to prevent raising of the door 27 prior to its being pivoted fully to its inclined position, as shown in FIG. 5, there are provided limit switches 122 in the fork members 121 which become actuated only when the shaft 55 is fully seated within the fork members 121. A control circuit associated with the switches 122 terminates operation of motor 88 and energizes motor 63 when the shaft 55 is fully engaged in the fork members 121.

As is evident from FIGS. 4 to 7, the ends of the horizontal tracks 45 closest to the wall 25 have curved down-turned ends **45*a*. These curved ends facilitate the transition of the movement of the top of the door from vertical to horizontal movement. However, upon the closing movement of the door when the mechanism 57 operates to move the door from the tilted (FIG. 5 position) to the vertical position, there is a tendency for the rollers 49 to move back up the track 45. To overcome this tendency, there is provided a latch mechanism 125 which, includes a solenoid 125*a*, a latch bar 125*b* operated by the solenoid and a limit switch 125*c*. The limit switch 125*c* is connected to energize the solenoid causing the latch bar 125*b* to be inserted into track 45 blocking the roller 49 from moving away from the end of track 45. Thus, when the mechanism 57 is actuated to displace the shaft 55 away from the door 27 to rotate the door from its tilted to the vertical position, the rollers 49 will be restrained by the latch mechanism 125 from moving along the tracks 45**.

As an alternative embodiment, there is shown in FIG. 7A a modified horizontal track 45' which eliminates the need for the latch mechanism 125. The horizontal track 45' is formed with a curved end portion 46' which causes the rollers 49 to move in a substantially vertical direction as they approach the limit of their movement in the tracks 45'. The arrow "F", as shown in FIG. 7A, illustrates the direction of the force exerted on the shaft 55 by the mechanism 57 in moving the door 27 from the angled to the vertical position. Since this force is slightly downward and the track 46' in which the rollers 49 are positioned is substantially vertical, there is no tendency for the mechanism 57 to drive the rollers 49 back up the track 45' during the final closing of the door 27.

Figure 20:
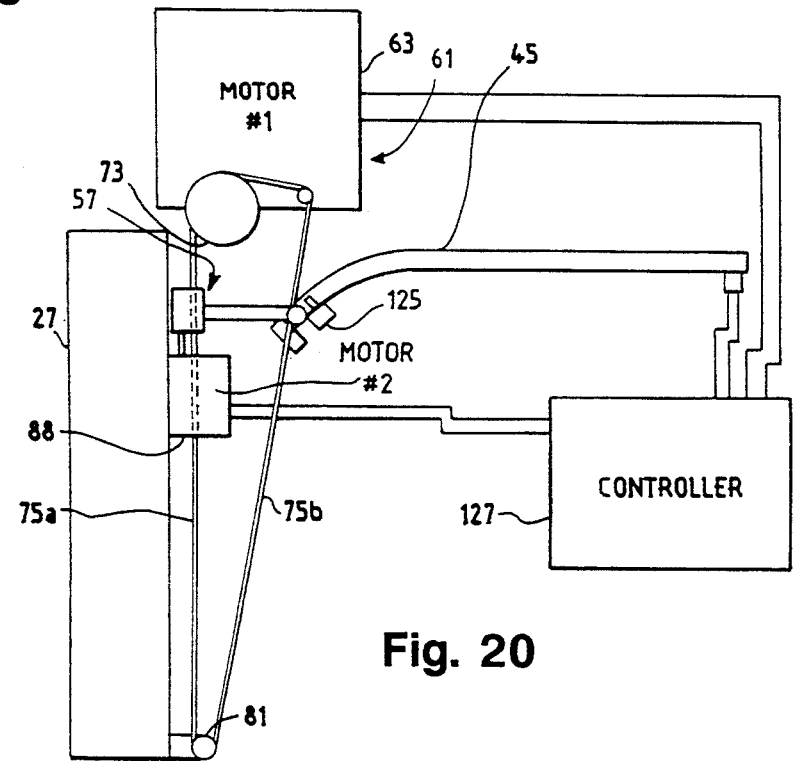
FIG. 20 is a schematic diagram of the control circuit for the power operated door of the invention.

The operation of door tilting mechanism 57 and the door raising mechanism 61 may be operated by a controller 127 as shown schematically in FIG. 20 as operating the lever mechanism 57 and the power drive mechanism 61. The controller 127 includes the conventional safety motor reversing circuits whereby operation of the motor 63 in the door closing direction would be arrested and reversed if the door encountered an obstacle. Such motor reversing circuits are responsive to motor load or speed so that if the door engages an obstacle as it is closing the increased load on the motor or decreased speed of the motor is sensed and the circuit switches the motor to reverse its direction of rotation. The actual means for sensing the decreased motor speed or increased load to reverse the motor may be associated with the motor 63 providing the reversing signal to the controller 127. The fact that the cable 75 provides a positive driving force on the door in both the opening and closing direction of movement assures that the safety motor reversing circuit will function properly.

While the present invention has been described above in the context of a flush mounted garage door which may be concealed in the exterior wall of a residential building, it has broader aspects as means and method of concealing one or more garages within a residential building. It has been common in the prior art to provide various types of decorative features associated with recessed garage doors to render them more attractive visually. Since the present invention makes it possible to hide or conceal the garage door itself, it becomes desirable to take further steps to conceal the presence of the garage. In the normal situation, there is provided a driveway which extends from the street to the entrance to the garage. The driveway is somewhat wider than the width of the automobile and it may be paved or gravel, depending on various circumstances. The basic requirement is that the driveway provide a support or bearing surface which will prevent the wheels of the vehicle from sinking into the ground between the street and the garage. It has been conventional to gravel or pave a broad lane leading up to each garage door opening with the result being the elimination of much of the usual planting, lawn and vegetation which would otherwise be associated with the yard area adjacent the residential building. The present invention involves minimizing the driveway and utilizing foundation plantings to further hide and conceal the presence of the garage in the residence.

As is best shown in FIGS. 1 and 2 of the drawings, there are provided bearing tracks 140, 142, 144 and 146 which extend outwardly from the garage door openings 31 and 33. These tracks are spaced apart the distance required to be aligned with the tires of an automobile and are of a width of on the order of 15 to 24 inches. The tracks may be of any suitable bearing material such as concrete, brick or gravel, depending on the requirements to support an automobile under the local soil conditions. The garage openings 31 and 33 are indicated to have a width of W1 and W2, while the outer edges of each pair of tracks are located inwardly, since the door openings provide clearance between the sides of the automobiles and the edges of the door openings. With the vehicle supporting tracks being limited in width and disposed as shown in FIG. 1, there is ample space for the usual foundation plantings which are conventionally used to beautify a residential building.

Planted in the area on each side of the door openings 31 and 33 are evergreen trees 148 of the type normally used for such foundation plantings and normally attaining a height of several feet. Planted in the area between the pairs of tracks are flowers, ground cover or ground hugging evergreens, all of which would be selected to have a height of less than the ground clearance of the undercarriage of a normal vehicle. Thus, with the conventional types of foundation plantings extending along the base of the wall 25, there is little to cause one to believe that there are garages concealed within the front wall of the building. The tracks 140, 142, 144 and 146 may extend to a paved or graveled turnaround area 152 (outlined in dash lines in FIG. 1) or may extend to the street. In situations in which the tracks 140, 142, 144 and 146 are made of concrete, brick, blacktop or other hard surface, it is preferred that the tracks be formed with gravel portions 141, 143 and 145, as shown in FIGS. 1 and 2. The graveled portions 141, 143 and 145 are located adjacent the building B and within the area of the plantings 148 and 150 so as to simulate gravel disposed in flower bed areas for mulch purposes or to prevent the growth of unwanted weeds and the like. The use of such gravel portions adjacent to the building and within the area in which the plantings 148 and 150 are located tends to conceal the fact that the driveways lead into the building and the concealed garages. The foregoing provides a unique means and method of concealing garages within a residential building.

The power operated door of the present invention provides a unique advantage of permitting unlimited flexibility in the aesthetic design of a garage door which may be flush with or protrude forwardly of the front wall surface. The mechanism for withdrawing the door from the door opening is simple and relatively inexpensive while maintaining the safety features of less appealing recessed type doors.

What is claimed as new and desired to be secured by Letters Patent of the United States is:

1. A power operated door for installation in a building having a vertical wall with an outer surface and with a door opening in said wall comprising:

a one-piece door movable between a closed position disposed vertically in said door opening with said door being substantially flush with said outer surface of said vertical wall with said door filling said opening and a horizontal position above said opening, said door having an upper edge and a lower edge;

vertically extending tracks disposed adjacent said door opening;

horizontally extending tracks positioned above said door opening and extending inwardly from said door opening;

first bearing means at the lower edge of said one-piece door engageable in said vertically extending tracks for guiding said door for vertical movement;

second bearing means at the upper edge of said door engageable in said horizontally extending tracks for guiding said door for horizontal movement;

door drive mechanism including a first reversible motor, a flexible drive member drivingly connecting said motor and said door to raise and lower said door, a pulley fixedly supported adjacent said lower edge of said door in the closed position of said door, said flexible drive including a first portion extending from said motor to a connection to said door and a second portion extending from said motor around said pulley to a connection to said door, said connection to said door by said first and second portions of said flexible drive member being located at said first bearing means;

and a control circuit for driving said motor in a first direction for closing said door and a second direction for opening said door, said circuit including means responsive to motor rotation to reverse said motor upon said door engaging an obstruction to the closing of said door.

2. The power operated door in accordance with claim 1 including means for rotating said door about said first bearing means to move said upper edge of said door inwardly of said door opening from said closed position before moving said door upwardly.

3. A power operated door for installation in a building having a vertical wall with a door opening comprising:

a one-piece door movable between a closed position disposed vertically in said door opening and a horizontal ,position above said opening, said door having an upper edge and a lower edge;

vertically extending tracks disposed adjacent said door opening;

horizontally extending tracks positioned above said door opening and extending inwardly from said door opening;

first bearing means at the lower edge of said one-piece door engageable in said vertically extending tracks for guiding said door for vertical movement;

second bearing means at the upper edge of said door engageable in said horizontally extending tracks for guiding said door for horizontal movement;

door drive mechanism including a first reversible motor, a flexible drive member drivingly connecting said motor and said door to raise and lower said door, a pulley fixedly supported adjacent said lower edge of said door in the closed position of said door, said flexible drive including a first portion extending from said motor to a connection to said door and a second portion extending from said motor around said pulley to a connection to said door;

a control circuit for driving said motor in a first direction for closing said door and a second direction for opening said door, said circuit including means responsive to motor rotation to reverse said motor upon said door engaging an obstruction to the closing of said door, said second bearing means comprising a bearing shaft mounted adjacent the upper edge of said door for movement toward and away from said door, said door having a first portion positioned within said opening and having an outer face on said first portion which is substantially coextensive with the outside surface of said vertical wall, said door having a second portion which supports said first portion and includes peripheral edges extending along the sides and top of said door opening to engage and seal against the inside of said wall, shaft translation means connected to said door and said bearing shaft for rotating the top edge of said door inwardly out of said door opening.

4. The power operated door in accordance with claim 3 wherein said shaft translation means includes lever means pivotally connected to said bearing shaft and a second reversible motor drivingly connected to said lever means to rotate said lever means displacing said bearing shaft in a direction perpendicular to said door.

5. The power operated door in accordance with claim 4 wherein said lever means comprises a pair of yokes each pivotally connected at a first end to opposite ends of said bearing shaft and pivotally connected at a second end to one of two slide members mounted on a track carried by said door, drive means extending between said second motor and said slide members to drive said members toward each other upon rotation of said second motor in one direction and away from each other upon rotation in the other direction, rotation of said second motor in said one direction displacing said bearing shaft toward said door and rotation of said shaft in said other direction displacing said bearing shaft away from said door.

6. The power operated door in accordance with claim 5 including spaced shaft supports positioned on said door at opposite ends of said bearing shaft, said shaft supports receiving said bearing shaft when said bearing shaft is displaced toward said door to restrain said bearing shaft against displacement in a plane parallel to said door.

7. The power operated door in accordance with claim 6 wherein said shaft supports comprise channel shaped members having laterally opening recesses which receive said bearing shaft.

8. The power operated door in accordance with claim 3 wherein said horizontally extending tracks include outer ends which curve downwardly and which receive said second bearing means when said door is in its lowermost position, said second bearing means includes rollers carried on the ends of said bearing shaft and guided by said horizontally extending tracks.

9. The power operated door in accordance with claim 8 including automatically actuated locking means engaging said rollers at the outer ends of said horizontally extending tracks upon displacement of said bearing shaft away from said door to prevent displacement of said rollers within said tracks.

10. A power operated garage door movable from a vertically disposed closed position to a horizontally disposed raised opened position comprising;

a one-piece garage door having upper and lower edges and being supported by upper and lower bearings, extending horizontally adjacent said upper and lower edges;

a pair of vertically extending tracks guiding said lower bearings for vertical movement from a lower edge of a door opening to an upper edge of said door opening;

a pair of horizontally extending tracks guiding said upper bearings for horizontal movement on a plane above said door opening;

a first drive mechanism mounted on said door for displacing said upper bearings laterally with respect to said door to pivot said door about said lower bearings to an inwardly inclined position;

a second drive mechanism connected to said door adjacent the lower edge to drive said lower bearings upwardly in said vertical tracks to open said door and drive said lower bearings downwardly in said vertical tracks to close said door;

and control means operating said first and second drive mechanisms in sequence to open said door by pivoting said door inwardly with said first drive mechanism and then raising the lower edge of said door with said second drive mechanism to move said door from the vertical closed position to the horizontal raised opened position and in a reversed sequence to close said door.

11. The power operated garage door of claim 10 wherein said second drive mechanism includes a first flexible drive member extending upwardly from said lower bearings to pull said door upwardly and a second flexible drive member extending downwardly from said lower bearings to pull said door downwardly, said second drive mechanism including a reversible motor connected to drive said first and second flexible drive members in opposite directions on opening or closing of said door.

12. The power operated garage door of claim 11 wherein said first and second flexible drive members are cables connected between said lower bearings and a first pulley driven by said reversible motor, and a second pulley positioned below said lower bearings, said second flexible drive member extending downwardly from said lower bearings around said second pulley and upwardly into engagement with said first pulley.

13. The power operated garage door of claim 11 wherein said upper bearings comprise a horizontally extending shaft having rollers at each end, said rollers being received within and guided by said horizontally extending tracks support means mounting said shaft for lateral movement with respect to said door, said first drive mechanism including a reversible motor mounted on said door and drivingly connected to said support means.

14. The power operated garage door of claim 13 wherein said support means includes a pair of levers each pivotally connected at one end to said shaft, each said lever being connected pivotally at their other ends to slide members which are driven in rectilinear movement by said reversible motor mounted on said door, said slide members being driven toward and away from each other to displace said shaft away and toward said door.

15. The power operated garage door of claim 13 including a bearing locking means disposed in said horizontal tracks to lock said rollers at one end of said horizontal tracks at the limit of movement of said shaft toward said door opening, said control means operating said locking means after said second drive mechanism has driven said door from the horizontal raised opened position and before said first drive mechanism pivots said door to the vertical closed position.

16. The power operated garage door of claim 13 wherein said support means includes manually actuable latch means to selectively connect and disconnect said first drive mechanism from said horizontally extending shaft to permit manual opening and closing of said door in the event of a power failure.

17. A power operated door displaceably supported in a wall opening with said door and wall having a flush outer surface comprising:

a door panel being vertically positionable within said wall opening to close said opening and having peripheral edges at vertical sides and at a horizontal top edge to overlap wall portions defining the edges of said wall opening;

a decorative wall portion configured to simulate in appearance said wall adjacent to said wall opening;

said door panel having a support to mount said decorative wall portion with the decorative wall portion and said wall forming a continuous flush outer surface;

horizontally extending bearings carried by said panel to support said panel for pivotal movement about a bottom edge of said door to an inwardly tilted position wherein said door is angled a distance sufficient to withdraw the top of said door from within said opening;

vertical tracks receiving said horizontally extending bearings and extending vertically along the edges of said wall opening;

an upper support shaft having bearings at its ends and mounted on said door adjacent to said top edge and displaceable between a first position adjacent the door panel and a second position spaced outwardly of said door panel;

horizontally extending tracks disposed above said door opening and extending inwardly therefrom, said horizontally extending tracks receiving said upper support shaft bearings to guide the top of said door;

a first drive mechanism on said door driving said upper support shaft between said first and second positions;

a second drive mechanism on said wall driving said door between a lowered inwardly tilted position to an open horizontal position, flexible connectors extending between said second drive mechanism and said horizontally extending bearings to drive said door upwardly on opening and downwardly on closing; and circuit means connected to said second drive mechanism and responsive to motor speed reversing the direction of door movement when said door engages an obstruction.

18. The power operated door of claim 17 wherein said second drive mechanism comprises a reversible electric motor drivingly connected to a drum, said flexible connectors being a pair of cables which are anchored to said door and said drum, one of said cables pulling said door downwardly to move said door to its closed position and the other of said cables pulling said door upwardly to move said door to its open position.

19. The power operated door of claim 18 wherein said drum is disposed above one of said vertical tracks with the other of said cables extending vertically for connecting to one of said horizontally extending bearings, a pulley fixedly supported below said one of said horizontally extending bearings, said one of said cables extending from said drum and around said pulley into connection with said one of said horizontally extending bearings.

* * * * *